United States Patent [19]

Fleck et al.

[11] 4,288,288

[45] Sep. 8, 1981

[54] APPARATUS FOR MIXING CHEMICALS INTO PULP AT A REFINER INLET

[75] Inventors: John A. Fleck, Everett; Michael D. Meredith, Federal Way, both of Wash.

[73] Assignee: Weyerhaeuser Company, Tacoma, Wash.

[21] Appl. No.: 48,933

[22] Filed: Jun. 15, 1979

[51] Int. Cl.[3] ..... D21D 1/30

[52] U.S. Cl. ..... 162/261; 162/23; 162/26; 162/57; 239/548; 241/57; 261/93; 366/157; 366/168; 366/172; 68/5 B

[58] Field of Search ..... 366/167, 168, 173, 176, 366/178, 156, 157; 162/26, 23, 57, 63, 65, 66, 67, 243, 261; 261/93; 241/57, 46.06, 261.2, 28; 239/548, 549; 8/149.1, 156, 109; 68/5 B, 5 C, 5 D, 5 R

[56] References Cited

U.S. PATENT DOCUMENTS

| | | | |
|---|---|---|---|
| 1,960,613 | 5/1934 | Wolf et al. | 162/66 |
| 1,971,241 | 8/1934 | Weitzel | 162/66 |
| 2,641,164 | 6/1953 | Hill et al. | 162/26 |
| 2,717,195 | 9/1955 | Armstrong | 162/26 |
| 2,964,382 | 12/1960 | Hall, Jr. | 261/93 |
| 3,384,533 | 5/1968 | Robert et al. | 162/65 |
| 3,521,864 | 7/1970 | Welles, Jr. | 261/93 |
| 3,652,386 | 3/1972 | Noreus et al. | 162/65 |
| 3,881,986 | 5/1975 | Backlund | 162/63 |
| 4,082,233 | 4/1978 | Reinhall | 241/244 |
| 4,093,506 | 6/1978 | Richter | 162/57 |

FOREIGN PATENT DOCUMENTS

| | | | |
|---|---|---|---|
| 2441579 | 3/1975 | Fed. Rep. of Germany | 162/65 |
| 247233 | 3/1926 | Italy | 239/548 |

OTHER PUBLICATIONS

Kleppe et al., "Oxygen/Alkali Delignification at Kamyr Digester Blowline Consistency-A Status Report", TAPPI, vol. 59, No. 11, pp. 77-80, Nov. 1976.

Jenkin, "Pilot and Commercial Results of Medium Consistency Chlorination", Bleaching Seminar on Chlorination and Caustic Extraction, Wash., D.C., 11-10-1977.

Yrjala et al., "New Aspects in Oxygen Bleaching", Rauma-Repola Oy, Rauma, Finland, Apr. 18, 1974.

*Primary Examiner*—S. Leon Bashore
*Assistant Examiner*—Steve Alvo
*Attorney, Agent, or Firm*—Weyerhaeuser Company

[57] ABSTRACT

A design of a distribution unit allowing a gas or other material to be uniformly supplied to a mixing device close to the point of mixing. The distribution unit can be used for mixing chemicals into pulp at a refiner inlet.

15 Claims, 4 Drawing Figures

APPARATUS FOR MIXING CHEMICALS INTO PULP AT A REFINER INLET

BACKGROUND OF THE INVENTION

1. Field of the Invention

Mixing two materials.

2. Review of the Prior Art

The following definitions will be used in this application.

Pulping is the changing of wood chips or other wood particulate matter to fibrous form. Chemical pulping requires cooking of the chips in solution with a chemical, and includes partial removal of the coloring matter such as lignin associated with the wood.

Bleaching is the treatment of cellulosic fibers to remove or alter the coloring matter associated with the fibers to allow the fiber to reflect white light more truly.

Researchers attempting to add oxygen into the pulping process, or to replace portions of the system with oxygen processing, had a number of concerns. A continuing concern was the poor solubility of oxygen in water and its poor transference from the gas to the liquid phase and into the fiber. The usual solutions to these problems have been high pressures, high oxygen concentrations, and particular vessel configurations to promote the transfer of oxygen into the fiber.

Another concern was the degradation of the pulp by the oxygen. The solution to this problem was a protector of some kind. There are a number of patents which describe various protectors that might be used. Exemplary are Robert et al., U.S. Pat. No. 3,384,533, issued May 21, 1968; Noreus et al., U.S. Pat. No. 3,652,386, issued Mar. 28, 1972; and Smith et al., U.S. Pat. No. 3,657,065, issued Apr. 18, 1972.

There has also been a concern about channeling of the oxygen in the system and various ways to prevent channeling have been proposed. The Roymoulik et al. U.S. Pat. No. 3,832,276, issued Aug. 27, 1974, and Phillips U.S. Pat. No. 3,951,733, issued Apr. 20, 1976, note this problem and suggest solutions.

A great deal of art describes both oxygen bleaching of pulp or refining of pulp. The following patents and articles are exemplary.

The first is Laakso U.S. Pat. No. 4,002,528, which issued Jan. 11, 1977. This patent describes an environment for the present invention—two refiners 34 and 35 within the blow line 32 between digester 24 and a storage or blow tank 38.

The Kamyr blow line oxygen system is described in Richter, U.S. Pat. No. 3,963,561, issued June 15, 1976, and in Kleppe et al "Oxygen Alkali Delignification at Kamyr Digester Blow Line Consistency—status report," 1976 International Pulp Bleaching Conference, May 2-6, 1976, TAPPI November 1976, Vol. 59, No. 11, pp. 77-80. In this system, oxygen is added to the pulp in the blow line between the digester and the oxygen reactor. The oxygen is added just prior to a refiner located at the bottom of the reactor. The pulp is at a consistency of 5-20% and preferably 8-12%. The reactor is of an upflow-downflow type in which the pulp and oxygen are carried upward in a conical inner section of the reactor and flow downward in the outer section of the reactor. The pulp must remain in the inner upflow section of the reactor for from 20-30 minutes, allowing the pulp to become 90% oxidized. In the pilot plant the retention time in the inner upflow section of the reactor was 40 minutes.

The patent and article disclose a number of mechanical features within the reactor to keep the pulp from floating to the top and to ensure that the pulp remains within the conical inner section of the reactor the appropriate length of time. The patent is directed to the reuse of the excess oxygen within the system. The article describes this system in use at the Moss Norway plant.

The Rauma-Repola system is described in the Federal Republic of Germany patent disclosure No. 24 41 579, Mar. 13, 1975 and in Yrjala, et al., New Aspects in Oxygen Bleaching, dated Apr. 18, 1974. The system uses the Vortex mixer shown in FIGS. 2 and 3. Using either a number of passes through a single mixer or several mixers in series, it is possible to bleach the pulp in from 5 to 15 minutes. The consistency is 3%.

Richter U.S. Pat. No. 4,093,506, issued June 6, 1978, describes a mixer for mixing bleaching fluids such as chlorine or chlorine dioxide with a high-consistency pulp. Rapidly rotating rotor blades essentially fluidize the pulp and the treatment gas is added to it then. The Kamyr reactor is also described in an article, "Pilot and Commercial Results of Medium Consistency Chlorination" given at the Bleaching Seminar on Chlorination and Caustic Extraction, Nov. 10, 1977 in Washington, D.C.

Reinhall U.S. Pat. No. 4,082,233, issued Apr. 4, 1978, discloses a refiner having means for removing excess gas before the stock enters the refiner.

SUMMARY OF THE INVENTION

The inventors decided that better treatment of pulp with oxygen could be obtained if the oxygen were added to the pulp more uniformly and closer to the mixing action. They devised the present system which adds oxygen at the inlet of the mixing section, uniformly around the entrance.

DESCRIPTION OF THE PREFERRED EMBODIMENT

The drawings show our invention applied in a blow line refiner.

Figure 1:
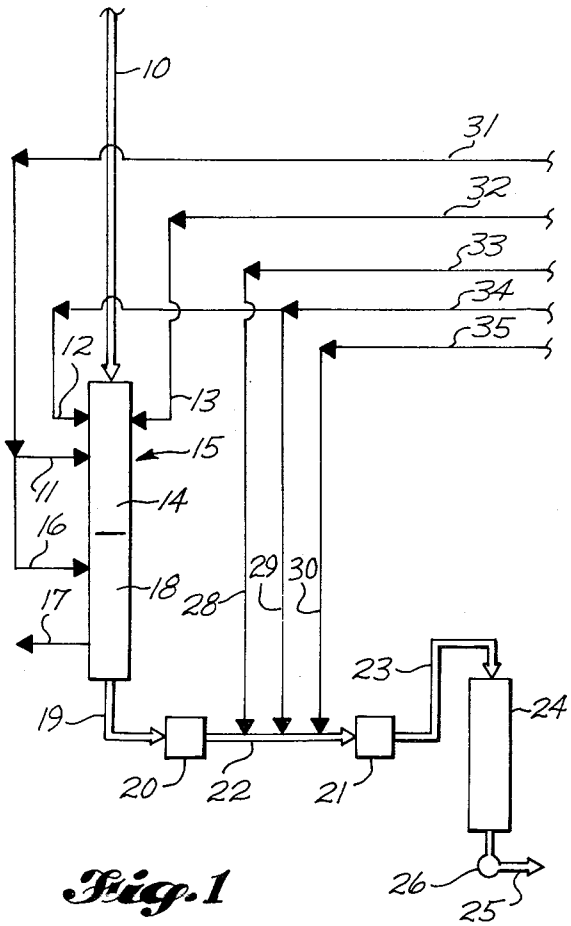
FIG. 1 is a diagram of a blow line oxygen system using a refiner.

FIG. 1 is a diagram of part of a pulp mill. Chips 10, process water 11, steam 12 and pulping chemicals 13 are fed to the pulping section 14 of digester 15. The digester 15 is continuous in operation. The wood chips 10 may be treated prior to entering the digester 15. This is optional. Exemplary of such treatment are presteaming of the chips in a steaming vessel or impregnation of the chips with the digestion chemicals in an impregnation vessel prior to entering the digester. The chemicals 13 entering the digester will depend on the process being used, be it sulfate, sulfite, or soda. The chips will be cooked in the pulping section 14 under conditions appropriate to the chemicals, wood species and type, and size of chip. These conditions are well known.

The products of the digestion process are the delignified or partially delignified wood chips, the spent pulping chemicals, and the lignin and carbohydrate products which have been removed from the wood chips in the digestion process. A major portion of the spent pulping chemicals and lignin products is removed from the chips prior to further processing. In the continuous digester shown, the chips are washed in the washing section of the digester. This is indicated by process water 16 entering and the effluent stream 17 leaving the washing stage 18 of digester 15. The effluent stream 17 will consist of the lignin and carbohydrates which have been removed from the chips during the digestion process and the spent digestion chemicals. This effluent will be carried to a treating facility. In the case of kraft or sulfate pulp this would be a recovery system in which the liquor is burned to recover the digestion chemicals for reuse.

Following this treatment, the chips will pass from the digester 15 through the blow line to storage or blow tank 24. It is customary in pulp mills to have storage tanks between processing steps so that the entire mill will not shut down if one section of the mill is shut down. Storage tank 24 is one such tank. It would be between the digester stage and the subsequent washing or bleaching stages. The storage tank 24 is open to the atmosphere and at atmospheric pressure. Line 25 and pump 26 carry the pulp from the tank 24.

The material passing through the blow line is a slurry which contains the remaining lignin and carbohydrates, the spent digestion chemicals, and the fibers formed from the chips as they are blown from the digester. The chips will be formed into fibers when the pressure on the chips is released, usually at the exit of digester 15. In a continuous digester, additional fiberizing may be done by a refiner, or refiners, in the blow line. The refiners will fiberize the large particles that have not been reduced to fibers earlier in the process. In the present diagram, two refiners—20 and 21—are shown. In the two-refiner system, the first refiner 20 does course refining and the second refiner 21 does fine refining.

The blow line is shown in three sections-section 19 between the digester 15 and refiner 20; section 22 between the refiners 20 and 21; and section 23 between the refiner 21 and the storage tank 24.

Sodium hydroxide and steam are added to the pulp slurry in line 22 between refiners 20 and 21 or just in front of refiner 21. Sodium hydroxide, which both adjusts the pH of the pulp and buffers the oxygen reaction, is added through line 28. Other suitable alkalies, such as white liquor, may also be used. Steam is added through line 29. The steam raises the temperature of the pulp to a temperature appropriate for the oxygenation. Oxygen is added to the pulp at the refiner through line 30.

The lines used to carry these various chemicals to the process are shown in the upper section of FIG. 1. Line 31 carries process water to lines 11 and 16. Line 32 carries chemicals to line 13. It may represent a number of chemical lines. Line 33 carries alkali to line 28. If the same chemical is used as the alkali and as the digestion chemical, then this line and line 32 would be the same line. Line 34 carries steam to lines 12 and 29. Line 35 carries oxygen to line 30.

Figure 2:
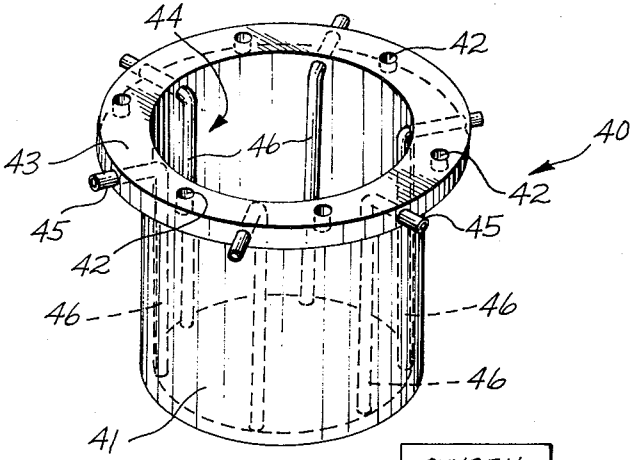
FIG. 2 is an isometric view of a diffuser used with a refiner to add the oxygen to the refiner.
Figure 3:
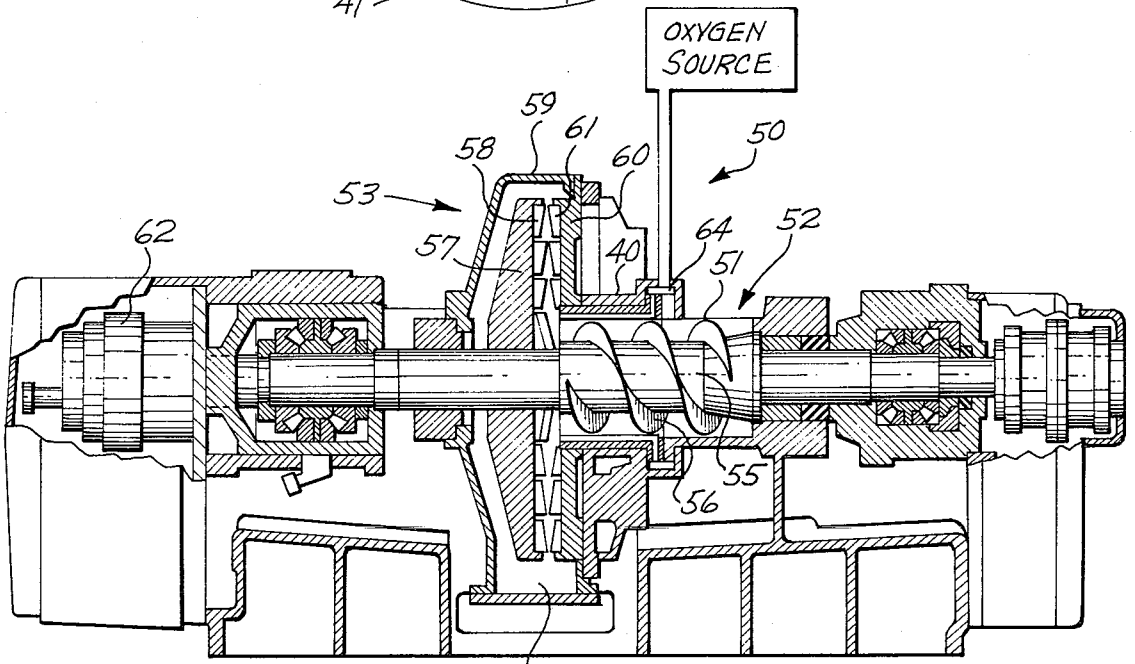
FIGS. 3 and 4 are cross sections of refiners, each with the diffuser of FIG. 2.
Figure 4:
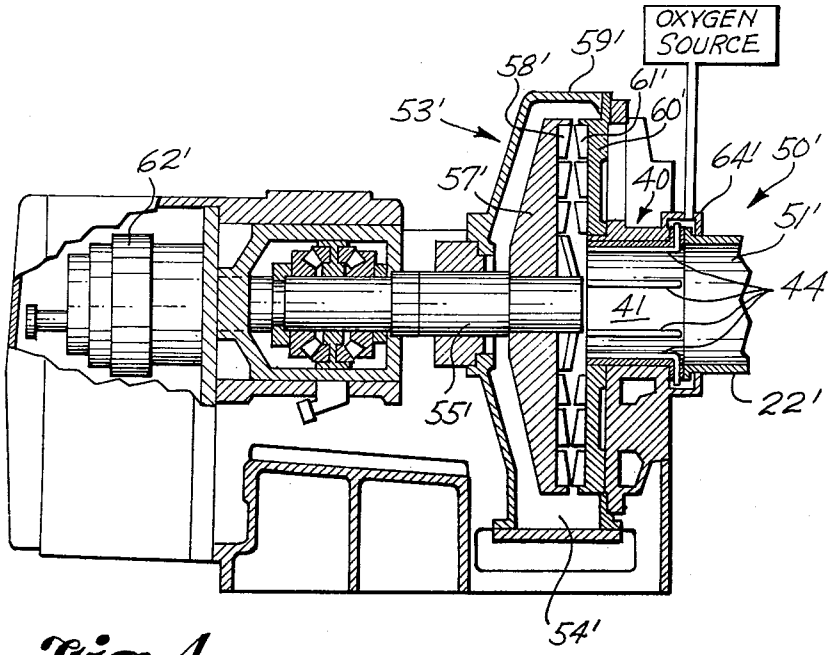

FIGS. 2, 3 and 4 show our unit for providing better distribution of the oxygen. FIG. 2 shows the distribution unit by itself and FIGS. 3 and 4 show cross sections of refiners using the unit.

The unit 40 consists of an inlet sleeve 41 which fits into the refiner casing inlet and is fixed in place by bolts which extend through holes 42 in flange 43. There are a plurality of L-shaped tubular diffusers 44 equally spaced and oriented axially around the sleeve and flange. Each diffuser has an inlet section 45 and an outlet section 46. The inlet section 45 extends radially along the flange 43 and the outlet section 46 extends longitudinally of the sleeve 41. The tube may have any cross section. There are several ways of attaching the diffusers 44 to the sleeve and flange. The inlet section 45 may be along the interior or exterior face of flange 43, be fitted in recesses in the interior or exterior face of flange 43, or be within and formed by the walls of the flange. In the latter design, an outlet tube would extend radially from the flange 43 as shown in FIG. 2. Similarly, the outlet section 46 could be affixed to the inner or outer wall of the sleeve 41, fitted into recesses in the inner or outer walls of the sleeve or be within and formed by the walls of the sleeve. They would be formed within and by the walls by casting when the sleeve and the flange are formed or by drilling through the wall. The preferred form is shown in FIG. 2. The inlet section 45 is formed in the flange and the outlet section 46 affixed to the inner wall of the sleeve. Each diffuser will have one or more outlets for oxygen. Six diffusers should adequately disperse the oxygen in the pulp.

In FIG. 3, the unit is shown with a refiner. A single disc refiner is shown. Only the major portions of the refiner are identified.

The refiner 50 has an inlet 51, a screw conveyor section 52, a refiner section 53 and an outlet 54. The refiner shaft 55 is within the casing. Attached to the shaft are screw conveyor 56 and the revolving refiner member 57. The revolving refiner plate 58 is attached to member 57. Attached to the refiner casing 59 are the fixed refiner member 60 and the fixed refiner plate 61 which is aligned with revolving plate 58. The shaft 55, conveyor 56, revolving refiner member 57 and plate 58 are rotated by a suitable motor 62.

In this refiner, the unit 40 would be part of the wear plate for the conveyer. The diffuser 44 would be recessed in the sleeve 41. This would allow the oxygen to be admitted after the conveyor section and as close as possible to the refiner plates so that there would be immediate mixing of the oxygen and pulp. Oxygen is fed to the diffusers through the oxygen manifold 64. The oxygen enters the diffusers 44 through the manifold 64 and is added to the pulp after the conveyer 56. The diffusers also dispense the oxygen finely and completely throughout the pulp. The oxygenated pulp leaves the refiner through the outlet 54.

The blow line 22 is attached to inlet 51.

FIG. 4 shows the use of unit 40 in a refiner that does not have a conveyer section. The reference numerals are the same as in FIG. 3.

In any type of refiner there is relative rotative movement between two opposed surfaces which are spaced to allow passage of material between them. Disc refiners are normally used because of the ability to change the clearance and pressure on the plates, depending on the furnish to the refiner and the end product desired. There are other types of refiners that may be used. In the usual double disc refiners, the rotating disc has refiner plates on both faces which act against opposing fixed plates. Another type of double disc refiner has both refiner plates mounted on discs which rotate in opposite directions to provide both a rolling and an abrading action. The discs are mounted on separate shafts which may be concentric. A conical refiner may also be used.

The diffuser unit may also be placed in the inlet of a mixing device. For example, the refiner, when stopped, may be used as a mixing device. The clearance between discs has been tested at around 13 mm and can be up to 75 mm. The clearance can be smaller. This clearance creates a mixing action between the pulp and oxygen.

What is claimed is:

1. Apparatus for mixing chemicals with pulp comprising a casing, a refiner section in said casing, a pair of opposed refiner plates in said refiner section rotatably movable with respect to each other, an inlet to said refiner section, said inlet having an inner wall, an outlet in said casing, a sleeve extending along the inner wall of said inlet, said sleeve having a wall with inner and outer surfaces, a plurality of parallel tubes oriented axially and distributed radially around the axis of said inlet and being part of said sleeve, means for holding said sleeve in position in said inlet, means associated with said tubes for providing chemicals through said tubes to the pulp.

2. The apparatus of claim 1 further comprising said tubes being attached to the inner wall of said sleeve, said sleeve lining the inner wall of said inlet.

3. The apparatus of claim 2 further comprising a flange attached to said sleeve, and each of said tubes being connected to a second tube, said second tubes extending radially along said flange, said chemical provision means providing chemicals to said pulp through said second tubes and said tubes.

4. The apparatus of claim 3 further comprising said second tubes being recessed within said flange.

5. The apparatus of claim 4 further comprising said tubes being recessed within the inner wall of said sleeve.

6. The apparatus of claim 3 further comprising said second tubes being within and formed by said flange.

7. The apparatus of claim 1 further comprising said tubes being attached to the outer wall of said sleeve, said tubes being along the inner wall of said inlet.

8. The apparatus of claim 7 further comprising a flange attached to said sleeve, and each of said tubes being connected to a second tube, said second tubes extending radially along said flange, said chemical provision means providing chemicals to said pulp through said second tubes and said tubes.

9. The apparatus of claim 8 further comprising said second tubes being recessed within said flange.

10. The apparatus of claim 9 further comprising said tubes being recessed within the outer wall of said sleeve.

11. The apparatus of claim 8 further comprising said second tubes being within and formed by said flange.

12. The apparatus of claim 1 further comprising said tubes being within and formed by the wall of said sleeve.

13. The apparatus of claim 12 further comprising a flange attached to said sleeve, and each of said tubes being connected to a second tube, said second tubes extending radially through said flange, and being within and formed by said flange, said chemical provision means providing chemicals to said pulp through said second tubes and said tubes.

14. The apparatus of claim 1 further comprising said tubes being recessed within the wall of said sleeve.

15. The apparatus of claim 14 further comprising a flange attached to said sleeve, and each of said tubes being connected to a second tube, said second tubes extending radially along said flange, said chemical provision means providing chemicals to said pulp through said second tubes and said tubes.

* * * * *